US011682328B2

(12) United States Patent
Yoo

(10) Patent No.: US 11,682,328 B2
(45) Date of Patent: Jun. 20, 2023

(54) DISPLAY MANUFACTURING SYSTEM AND DRIVING METHOD OF THE SAME

(71) Applicant: SAMSUNG DISPLAY CO., LTD., Yongin-si (KR)

(72) Inventor: Gi Na Yoo, Yongin-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/673,186

(22) Filed: Feb. 16, 2022

(65) Prior Publication Data

US 2023/0025419 A1 Jan. 26, 2023

(30) Foreign Application Priority Data

Jul. 23, 2021 (KR) ..... 10-2021-0097340

(51) Int. Cl.
*G09G 3/00* (2006.01)

(52) U.S. Cl.
CPC ..... *G09G 3/006* (2013.01); *G09G 2320/0626* (2013.01); *G09G 2330/02* (2013.01); *G09G 2360/04* (2013.01); *G09G 2360/16* (2013.01)

(58) Field of Classification Search
CPC ..... G09G 3/006; G09G 2320/0626; G09G 2330/02; G09G 2360/16
See application file for complete search history.

(56) References Cited

U.S. PATENT DOCUMENTS

| | | | | |
|---|---|---|---|---|
| 9,208,721 | B2 | 12/2015 | Odawara et al. | |
| 9,997,104 | B2 | 6/2018 | Zhang et al. | |
| 10,217,408 | B2 | 2/2019 | Tsuchida | |
| 10,565,927 | B2 | 2/2020 | Suk et al. | |
| 10,996,111 | B2 | 5/2021 | Yoo | |
| 2011/0298763 | A1* | 12/2011 | Mahajan | G09G 3/025 345/1.3 |
| 2014/0240305 | A1* | 8/2014 | Chae | G09G 3/3225 345/212 |
| 2019/0333452 | A1 | 10/2019 | Kim et al. | |

FOREIGN PATENT DOCUMENTS

| | | | |
|---|---|---|---|
| KR | 101276456 | B1 | 6/2013 |
| KR | 1020180071467 | A | 6/2018 |
| KR | 101964500 | B1 | 4/2019 |
| KR | 1020190125551 | A | 11/2019 |
| KR | 1020200108136 | A | 9/2020 |

* cited by examiner

*Primary Examiner* — Kenneth B Lee, Jr.
(74) *Attorney, Agent, or Firm* — Cantor Colburn LLP

(57) ABSTRACT

A display manufacturing system includes: a plurality of display devices, each including a display panel which displays an image; a driving voltage measurer which calculates a saturation voltage corresponding to a luminance of the image displayed on the display panel by changing a driving power voltage for driving the display panel; and a processor which calculates a current density and a degradation weight value based on the saturation voltage, and controls the display panel included in each of the plurality of display devices based on the current density and the degradation weight value.

13 Claims, 7 Drawing Sheets

DISPLAY MANUFACTURING SYSTEM AND DRIVING METHOD OF THE SAME

This application claims priority to Korean patent application 10-2021-0097340, filed on Jul. 23, 2021, and all the benefits accruing therefrom under 35 U.S.C. § 119, the content of which in its entirety is herein incorporated by reference.

BACKGROUND

1. Field

The disclosure generally relates to a display manufacturing system and a driving method of the display manufacturing system.

2. Related Art

With the development of information technologies, the importance of a display device which is a connection medium between a user and information increases. Accordingly, display devices such as a liquid crystal display device and an organic light emitting display device are widely used in various fields.

Conventionally, various techniques for manufacturing display device by predicting a lifetime distribution of display devices and compensating for the predicted lifetime distribution of display devices have been studied to improve display quality.

SUMMARY

When predicting a lifetime distribution of display devices and compensating for the predicted lifetime distribution thereof to improve display quality, it may be desired to rapidly predict the lifetime distribution of the display devices in a process of manufacturing the display devices to reduce manufacturing time and improve productivity.

Embodiments provide a display manufacturing system and a driving method of the display manufacturing system, in which a lifetime distribution is predicted through measurement of a driving power voltage in a process of manufacturing display devices, and an afterimage of the manufactured display devices is compensated by using the predicted lifetime distribution.

Embodiments also provide a display manufacturing system and a driving method of the display manufacturing system, in which a lifetime distribution is predicted in a process of manufacturing display devices, thereby reducing manufacturing time and improving productivity.

In accordance with an embodiment of the disclosure, a display manufacturing system includes: a plurality of display devices, each including a display panel which displays an image; a driving voltage measurer which calculates a saturation voltage corresponding to a luminance of the image displayed on the display panel by changing a driving power voltage for driving the display panel; and a processor which calculates a current density and a degradation weight value, based on the saturation voltage, and controls the display panel included in each of the plurality of display devices based on the current density and the degradation weight value.

In an embodiment, the saturation voltage may be a voltage corresponding to a point at which a variation of the luminance is changed as the driving power voltage connected to a light emitting element of the display panel is changed.

In an embodiment, the processor may include: a memory which pre-stores a plurality of parameters for calculating the current density and the degradation weight value; and a calculator which calculates the current density and the degradation weight value, based on the plurality parameters.

In an embodiment, the calculator may calculate the degradation weight value, based on a center value of the current density of the display panel included in each of the plurality of display devices and the current density of a target display panel.

In an embodiment, the calculator may calculate the degradation weight value, based on a center value of the luminance of the display panel included in each of the plurality of display devices and the luminance of the target display panel.

In an embodiment, the memory may pre-store the current density corresponding to a change in driving voltage of the light emitting element of the display panel. In such an embodiment, the driving voltage of the light emitting element may be a voltage higher by a threshold voltage of the light emitting element than the driving power voltage.

In an embodiment, the driving voltage of the light emitting element may be a voltage corresponding to at a point at which a current flowing through the light emitting element and a current flowing through a driving transistor of the display panel are the same as each other.

In an embodiment, the calculator may calculate the current density corresponding to the saturation voltage by using the current density pre-stored in the memory.

In an embodiment, the image may be displayed by using at least one of a first color, a second color, and a third color. In such an embodiment, the current density may be calculated when the image is displayed by using any one of the first color, the second color, and the third color.

In an embodiment, the display panel may include a plurality of pixels. In such an embodiment, the calculator may calculate the current density and the degradation weight value, based on a center value of the current density of the plurality of pixels and a center value of the current density calculated in a target pixel.

In accordance with an embodiment of the disclosure, a method of driving a display manufacturing system including a plurality of display devices, a driving voltage measurer, and a processor, the method includes: displaying, by a display panel, an image, where the display panel is included in each of the plurality of display devices; calculating, by the driving voltage measurer, a saturation voltage corresponding to a luminance of the image displayed on the display panel by changing a driving power voltage for driving the display panel; and calculating, by the processor, a current density and a degradation weight value, based on the saturation voltage, and controlling the display panel included in each of the plurality of display devices based on the current density and the degradation weight value.

In an embodiment, the calculating the saturation voltage corresponding to the luminance may include determining, by the driving voltage measurer, as the saturation voltage, a voltage corresponding to a point at which a variation of the luminance is changed as the driving power voltage connected to a light emitting element of the display panel is changed.

In an embodiment, the processor may include a memory and a calculator. In such an embodiment, the calculating, by the processor, the current density and the degradation weight value, based on the saturation voltage may include: pre-storing, by the memory, a plurality of parameters for calculating the current density and the degradation weight value;

and calculating, by the calculator, the current density and the degradation weight value, based on the plurality of parameters.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1:
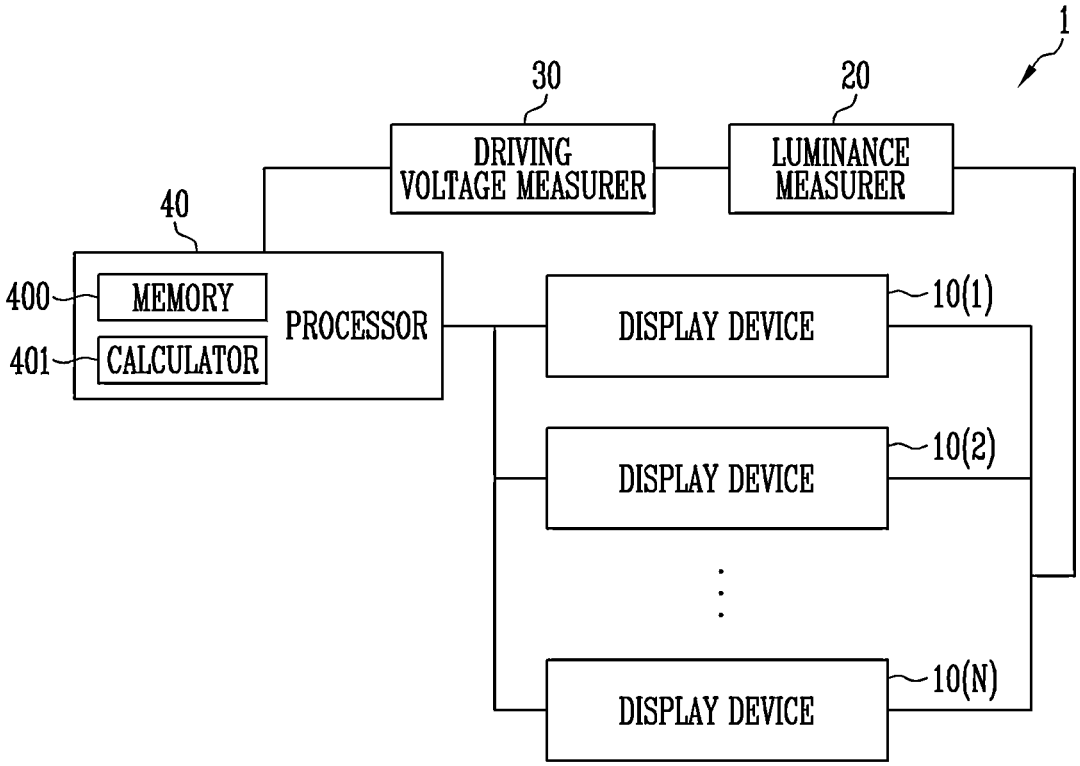
FIG. 1 is a diagram illustrating a display manufacturing system in accordance with an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

In the drawing figures, dimensions may be exaggerated for clarity of illustration. It will be understood that when an element is referred to as being "between" two elements, it can be the only element between the two elements, or one or more intervening elements may also be present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Hereinafter, embodiments of the invention will be described in detail with reference to the accompanying drawings.

Figure 2:
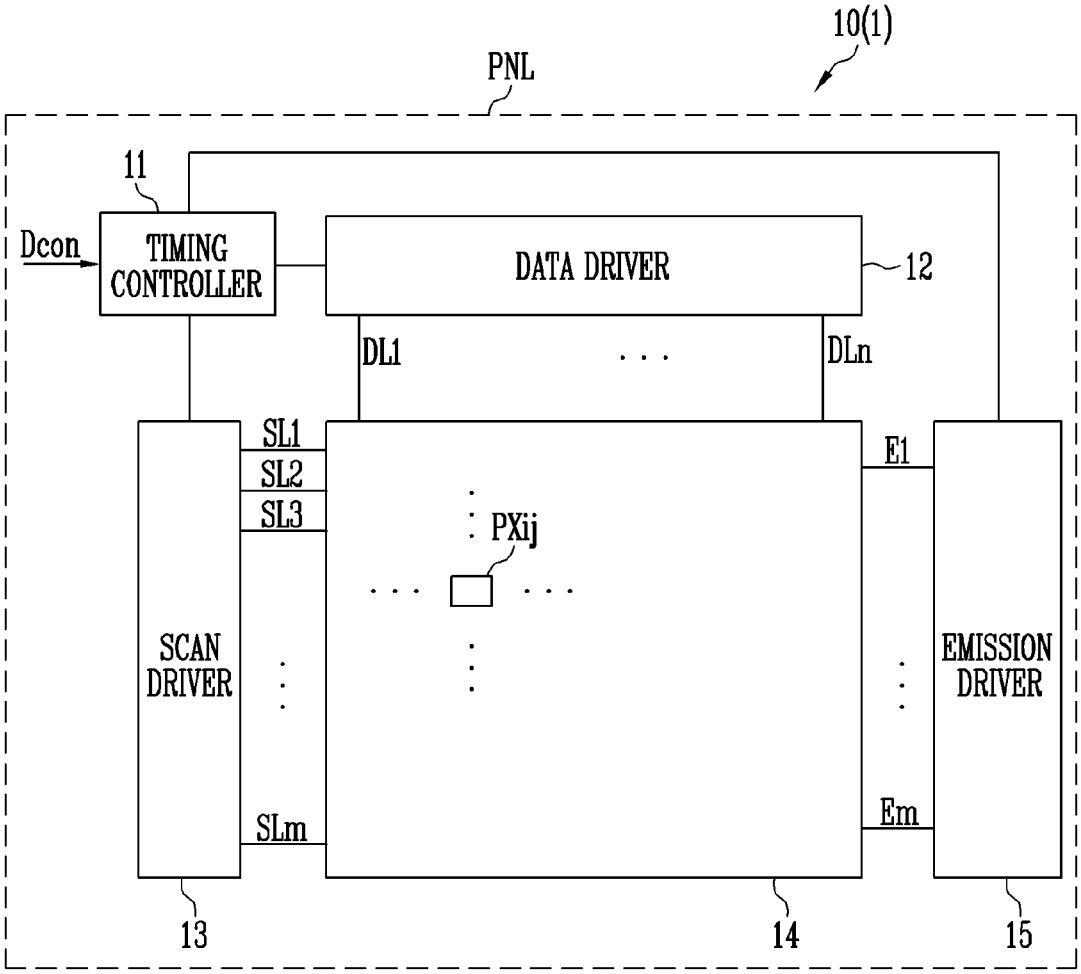
FIG. 2 is a diagram illustrating a display device in accordance with an embodiment of the disclosure.

FIG. 1 is a diagram illustrating a display manufacturing system in accordance with an embodiment of the disclosure. FIG. 2 is a diagram illustrating a display device in accordance with an embodiment of the disclosure. Hereinafter, embodiments of the display manufacturing system and the display device will be described in detail with reference to FIGS. 1 and 2.

Referring to FIG. 1, an embodiment of the display manufacturing system 1 (or a system for manufacturing a display device) in accordance with the disclosure may include a plurality of display devices 10(1) to 10(N), a luminance measurer 20, a driving voltage measurer 30, and a processor 40.

Referring to FIG. 2, although an embodiment of a display device 10(1) is illustrated, other display devices 10(2) to 10(N) are identical to the display device 10(1), and therefore, any repetitive detailed descriptions of the other display devices 10(2) to 10(N) will be omitted.

Referring to FIGS. 1 and 2, an embodiment of the display device 10(1) may include a display panel PNL including a timing controller 11, a data driver 12, a scan driver 13, a pixel unit 14, and an emission driver 15.

In an alternative embodiment, the display panel PNL may be defined by at least some components among the timing controller 11, the data driver 12, the scan driver 13, the pixel unit 14, and the emission driver 15.

The timing controller 11 may receive an external input signal from the processor 40. The external input signal may include a vertical synchronization signal, a horizontal synchronization signal, a data enable signal, RGB data, a data control signal Dcon, and the like.

The vertical synchronization signal may include a plurality of pulses, and indicate that a previous frame period is ended and a current frame period is started with respect to a point at which each of the pulses is generated. An interval between adjacent pulses of the vertical synchronization signal may correspond to one frame period. The horizontal synchronization signal may include a plurality of pulses, and indicate that a previous horizontal period is ended and a new horizontal period is started with respect to a point at which each of the pulses is generated. An interval between adjacent pulses of the horizontal synchronization signal may correspond to one horizontal period.

The data enable signal may indicate that RGB data is supplied in a horizontal period. The RGB data may be supplied in units of pixel rows in horizontal periods, corresponding to the data enable signal. RGB data corresponding to one frame may be referred to as one input image. The data control signal Dcon may include data about a degradation weight value B (see FIG. 8) of each of the plurality of display devices 10(1) to 10(N).

In an embodiment of the disclosure, the data control signal Dcon may include data (or a degradation weight value B) for compensating for a lifetime characteristic (e.g., after-image occurrence according to display use time) between the plurality of display devices 10(1) to 10(N) produced based on a driving voltage Vel (see FIG. 5) of the plurality of display devices 10(1) to 10(N) in a manufacturing process of the plurality of display devices 10(1) to 10(N). The timing controller 11 may output a control signal for controlling the data driver 12, based on the data control signal Dcon.

In an embodiment, the data control signal Dcon may be supplied from the processor 40 in a manufacturing process of the display device 10(1). In such an embodiment, the data control signal Dcon is not supplied to the timing controller 11 in a period in which the display device 10(1) normally implements an image. In an embodiment, the timing controller 11 may store information on the degradation weight value B included in the data control signal Dcon supplied from the processor 40 in the manufacturing process, and control data and the like by using the stored information on the degradation weight value B.

The data driver 12 may provide pixels PXij with data signals (or data voltages) corresponding to grayscales of an input image. In an embodiment, for example, the data driver 12 may sample grayscales by using a clock signal. The data driver 12 may apply data signals corresponding to the sampled grayscales to output lines D1 to Dn. Here, n may be an integer greater than 0.

The data driver 12 may provide corrected data voltages to the pixels PXij, corresponding to the control signal output from the timing controller 11. The corrected data voltages may correspond to a voltage obtained by adding the degradation weight value B to a data voltage value output from the data driver 12 in a process of measuring the driving voltage Vel of the plurality of produced display devices 10(1) to 10(N).

The scan driver 13 may receive a clock signal, a scan start signal, and the like from the timing controller 11, and generate scan signals to be provided to scan lines SL1 to SLm.

The pixel unit 14 may include pixels PXij. Each pixel PXij may be connected to a corresponding data line among data lines DL1 to DLn and a corresponding scan line among the scan lines SL1 to SLm. Here, i and j may be integers greater than 0. In addition, m may be an integer greater than 0.

The emission driver 15 may receive a clock signal, an emission stop signal, and the like from the timing controller 11, and generate emission control signals to be provided to emission control lines E1 to Em. Each pixel PXij may further include a transistor connected to a corresponding emission control line among the emission control lines E1 to Em. The transistor may be turned off during a data write period of each pixel PXij to suspend light emission of the pixel PXij.

The luminance measurer 20 may be separately provided at the outside of the plurality of display devices 10(1) to 10(N). The luminance measurer 20 may measure a luminance LUM (see FIG. 6) of an image displayed on the display panel PNL while a second driving power voltage ELVSS (see FIG. 3) for driving the pixel unit 14 provided in each of the plurality of display devices 10(1) to 10(N) is changed.

The driving voltage measurer 30 may measure the second driving power voltage ELVSS which is changed. The driving voltage measurer 30 may calculate a saturation voltage Vsat of a light emitting element EL (see FIG. 3) provided in each of the plurality of display devices 10(1) to 10(N), corresponding to the luminance LUM measured by the luminance measurer 20. The process in which the driving voltage measurer 30 calculates the saturation voltage Vsat of the light emitting element EL will be described in detail below with reference to FIG. 6.

The processor 40 may include a memory 400 and a calculator 401.

The memory 400 may pre-store a plurality of parameters for calculating a current density CDT (see FIG. 7) by using the saturation voltage Vsat calculated by the driving voltage measurer 30. The memory 400 may pre-store a plurality of parameters for calculating the degradation weight value B by using the current density CDT.

The calculator 401 may calculate the current density CDT by using the plurality of parameters stored in the memory 400 and the saturation voltage Vsat calculated by the driving voltage measurer 30. The calculator 401 may calculate the degradation weight value B by using the plurality of parameters stored in the memory 400 and the current density CDT.

The processor 40 may output, to the timing controller 11, the control signal Dcon to which the degradation weight value B calculated by the calculator 401 is reflected.

Figure 3:
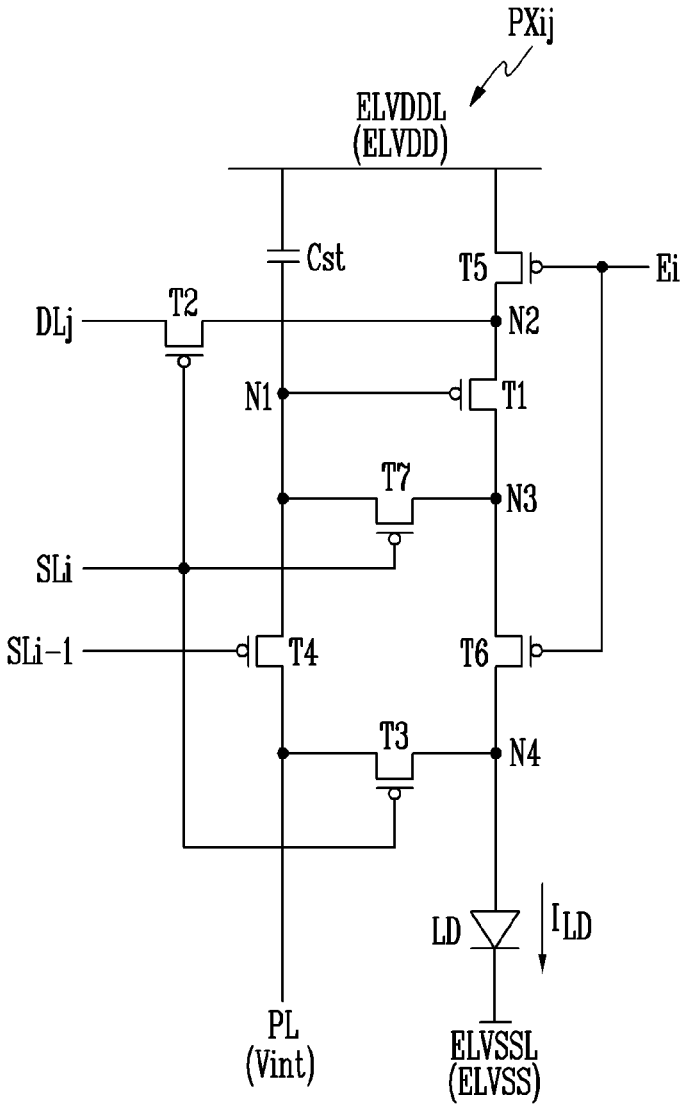
FIG. 3 is a diagram illustrating an embodiment of a pixel included in the display device shown in FIG. 2.

FIG. 3 is a diagram illustrating an embodiment of the pixel included in the display device shown in FIG. 2.

For convenience of illustration and description, a pixel which is located on an i-th horizontal line and is connected to a j-th data line DLj is illustrated in FIG. 3.

Referring to FIG. 3, an embodiment of the pixel PXij provided in the display device 10(1) may include a light emitting element EL, transistors T1 to T7, and a storage capacitor Cst. However, the structure of the pixel PXij is not limited to the structure show in FIG. 3, and may be variously modified. Hereinafter, an embodiment of the pixel PXij having the structure shown in FIG. 3 will be described in detail.

In such an embodiment, a first electrode (e.g., an anode or cathode electrode) of the light emitting element EL may be connected to a fourth node N4, and a second electrode (e.g., a cathode or anode electrode) of the light emitting element EL may be connected to a second driving power voltage ELVSS. The light emitting element EL generates light with a predetermined luminance, corresponding to an amount of current supplied from a first transistor T1.

In an embodiment, the light emitting element EL may be an organic light emitting diode including an organic emitting layer. In an alternative embodiment, the light emitting element EL may be an inorganic light emitting element including or formed of an inorganic material. Alternatively, the light emitting element EL may have a form in which inorganic light emitting elements are connected to each other in parallel and/or series between the second driving power voltage ELVSS and the fourth node N4.

A first electrode of the first transistor T1 (or driving transistor) may be connected to a second node N2, and a second electrode of the first transistor T1 may be connected to a third node N3. A gate electrode of the first transistor T1 may be connected to a first node N1. The first transistor T1 may control a driving current IES flowing from a first driving power voltage ELVDD to the second driving power voltage ELVSS via the light emitting element EL, based on a voltage of the first node N1. The first driving power voltage ELVDD may be set as a voltage higher than that of the second driving power voltage ELVSS.

A second transistor T2 may be connected between the j-th data line DLj and the second node N2. A gate electrode of the second transistor T2 may be connected to an i-th scan line SLi. The second transistor T2 may be turned on by a gate-on level of a scan signal supplied to the i-th scan line SLi, to electrically connect the j-th data line DLj and the second node N2 to each other.

A third transistor T3 may be connected between the first electrode of the light emitting element EL (i.e., the fourth node N4) and a power line PL through which an initialization voltage Vint is supplied. A gate electrode of the third transistor T3 may be connected to the i-th scan line SLi. The third transistor T3 may be turned on by the gate-on level of the scan signal supplied to the i-th scan line SLi, to supply the initialization voltage Vint to the first electrode of the light emitting element EL (i.e., the fourth node N4).

A fourth transistor T4 may be connected between the first node N1 and the power line PL. A gate electrode of the fourth transistor T4 may be turned on by a gate-on level of a scan signal supplied to an (i−1)-th scan line SLi−1, to supply the initialization voltage Vint to the first node N1.

A fifth transistor T5 may be connected between the first driving power voltage ELVDD and the second node N2. A gate electrode of the fifth transistor T5 may be connected to an i-th emission control line Ei. The fifth transistor T5 may be turned on by a gate-on level of an emission control signal supplied to the i-th emission control line Ei.

A sixth transistor T6 may be connected between the second electrode of the first transistor T1 (i.e., the third node N3) and the first electrode of the light emitting element EL (i.e., the fourth node N4). A gate electrode of the sixth transistor T6 may be connected to the i-th emission control line Ei. The sixth transistor T6 may be turned on by the gate-on level of the emission control signal supplied to the i-th emission control line Ei. Therefore, the fifth transistor T5 and the sixth transistor T6 may be simultaneously controlled by the emission control signal.

A seventh transistor T7 may be connected between the second electrode of the first transistor T1 (i.e., the third node N3) and the first node N1. A gate electrode of the seventh transistor T7 may be connected to the i-th scan line SLi. The seventh transistor T7 may be turned on by the gate-on level of the scan signal supplied to the i-th scan line SLi, to electrically connect the second electrode of the first transistor T1 and the first node N1 to each other. When the seventh transistor T7 is turned on, the first transistor T1 may be connected in a diode form.

The storage capacitor Cst may be connected between the first driving power voltage ELVDD and the first node N1.

Figure 4:
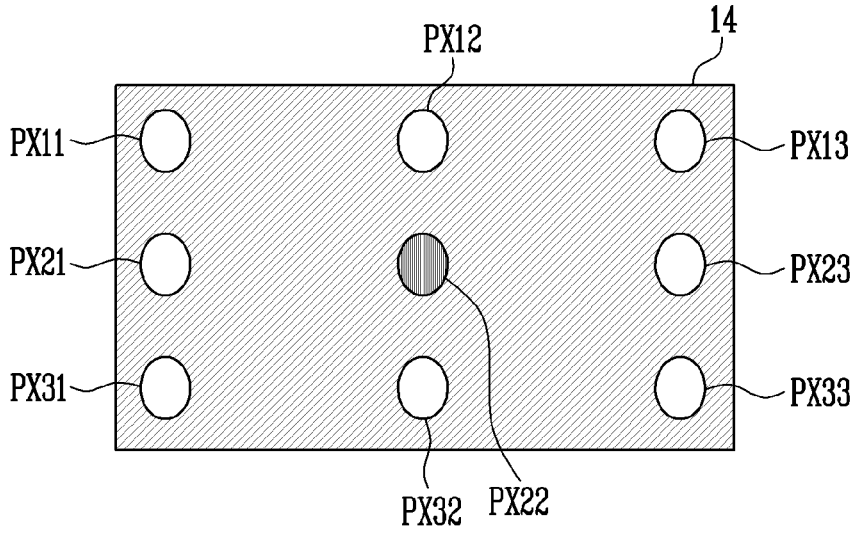
FIG. 4 is a diagram illustrating a pixel unit included in the display device shown in FIG. 2.

FIG. 4 is a diagram illustrating the pixel unit included in the display device shown in FIG. 2.

Referring to FIG. 4, an embodiment of the pixel unit 14 may include a plurality of pixels PX11, PX21, PX31, PX12, PX22, PX32, PX13, PX23, and PX33. Although an embodiment where the pixel unit 14 includes 9 pixels is illustrated in FIG. 4, the disclosure is not limited thereto.

In an embodiment, the luminance measurer 20 may measure a luminance of a central portion of the pixel unit 14, and measure a driving voltage Vel of a light emitting element EL provided in a pixel PX22 included in the central portion, to predict a lifetime characteristic of the plurality of display devices 10(1) to 10(N) produced in a manufacturing process of the plurality of display devices 10(1) to 10(N) and compensate for an afterimage occurring according to display use time. In an embodiment shown in FIG. 4, the pixel PX22 is the central portion of the pixel unit 14.

Hereinafter, in embodiments shown in FIGS. 4 to 8, it is assumed that only one pixel PX22 (or central pixel) included in the pixel unit 14 is driven. In an embodiment, for example, where the area of the pixel unit 14 corresponds to a small area, distances between the plurality of pixels PX11, PX21, PX31, PX12, PX22, PX32, PX13, PX23, and PX33 included in the pixel unit 14 are narrow. Therefore, only one central pixel PX22 included in each of the plurality of display devices 10(1) to 10(N) may be partially driven, thereby measuring a driving voltage Vel of the light emitting element EL provided in the central pixel PX22. The driving voltage Vel of the light emitting element EL corresponds to a voltage of the first electrode of the light emitting element EL (i.e., the fourth node N4).

In embodiments shown in FIGS. 4 to 8, it is assumed that the central pixel PX22 emits light of one color to measure the driving voltage Vel of the light emitting element EL provided in the pixel PX22 corresponding to the central portion of the pixel unit 14. When the central pixel PX22 emits light of only one color, the pixel unit 14 may emit light with a high luminance, to compare driving voltages Vel between the plurality of display devices 10(1) to 10(N).

In embodiments shown in FIGS. 4 to 8, it is assumed that central pixels PX22 included in the plurality of display devices 10(1) to 10(N) emit light of only one color among a first color (red), a second color (blue), and a third color (green), for example. The luminance measurer 20 may measure a luminance LUM of the central pixel PX22 emitting light of only one color, and measure a driving voltage Vel of the light emitting element EL.

Figure 5:
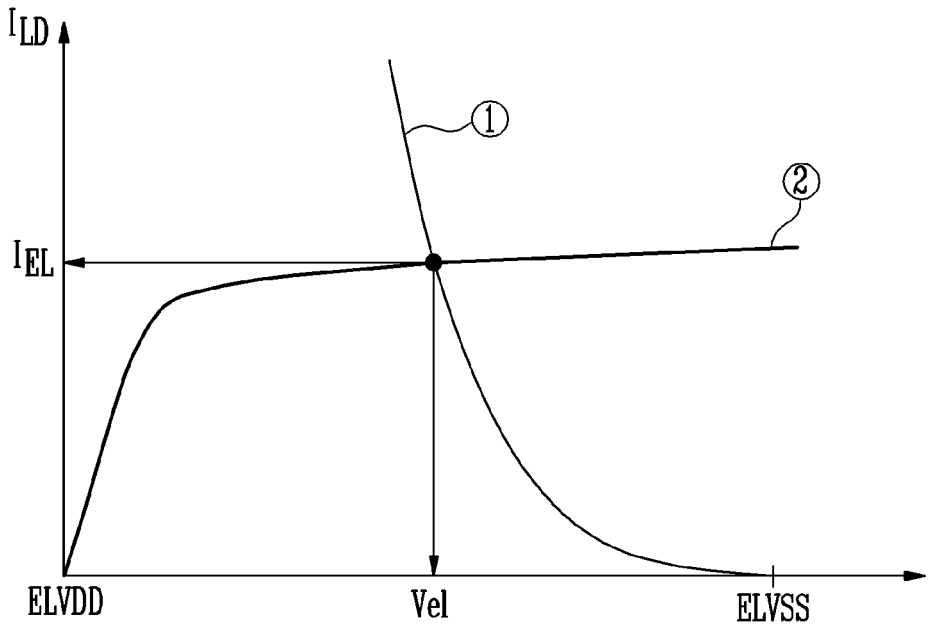
FIG. 5 is a diagram illustrating an embodiment of determining a driving voltage of a light emitting element of each of a plurality of display devices shown in FIG. 1.

FIG. 5 is a diagram illustrating an embodiment of determining a driving voltage of a light emitting element of each of the plurality of display devices shown in FIG. 1.

Referring to FIGS. 3 to 5, in an embodiment, a voltage of the first electrode (or the fourth node N4) of the light emitting element EL (or a driving voltage Vel of the light emitting element EL) provided in each of the plurality of display devices 10(1) to 10(N) may be measured with a same reference to measure a driving voltage Vel of the central pixel PX22 included in each of the plurality of display devices 10(1) to 10(N).

In an embodiment, for example, the voltage of the first electrode (or the fourth node N4) of the light emitting element EL may be arbitrarily changed. Specifically, when the voltage of the first electrode (or the fourth node N4) of the light emitting element EL is changed from the first driving power voltage ELVDD to the second driving power voltage ELVSS, a driving current $I_{EL}$ flowing through the light emitting element EL may decrease (graph ① in FIG. 5). In addition, a driving current $I_{EL}$ flowing through the first transistor T1 may increase (graph ② in FIG. 5).

A voltage at which the driving current $I_{EL}$ flowing through the light emitting element EL and the driving current $I_{EL}$ flowing through the first transistor T1 correspond to each other at the same time (or are the same as each other) may be the driving voltage Vel of the light emitting element EL.

In such an embodiment, as described above, the voltage at which the driving current $I_{EL}$ flowing through the light emitting element EL provided in each of the plurality of display devices 10(1) to 10(N) and the driving current $I_{EL}$ flowing through the first transistor T1 provided in each of the plurality of display devices 10(1) to 10(N) correspond to each other at the same time may correspond to the driving voltage Vel of the light emitting element EL provided in each of the plurality of display devices 10(1) to 10(N).

Figure 6:
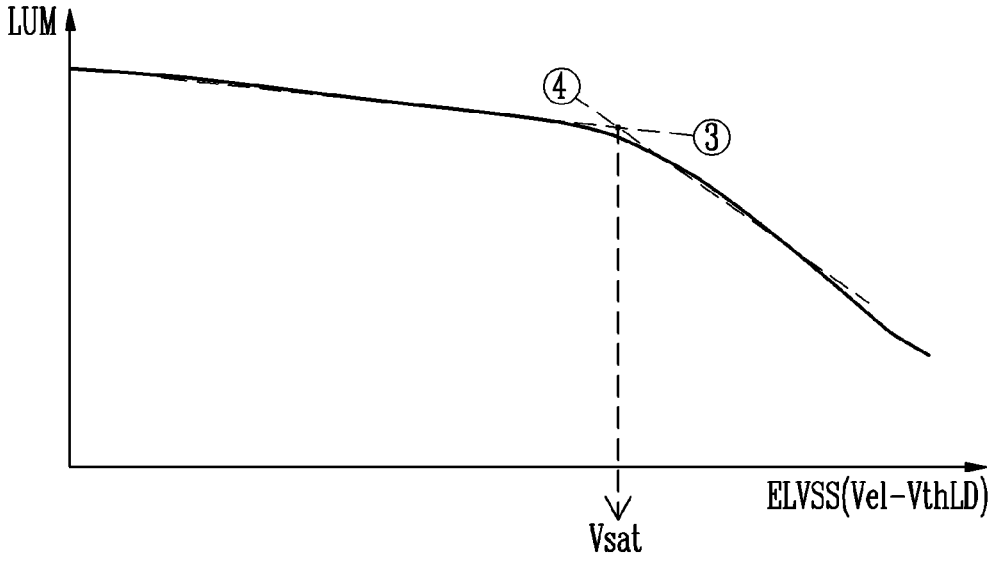
FIG. 6 is a diagram illustrating an embodiment of calculating a saturation voltage of the light emitting element of each of the plurality of display devices shown in FIG. 1.

In such an embodiment, a saturation voltage Vsat (see FIG. 6) of the light emitting element EL provided in each of the plurality of display devices 10(1) to 10(N) as shown in FIG. 6 may be calculated by considering the driving voltage Vel of the light emitting element EL provided in each of the plurality of display devices 10(1) to 10(N).

FIG. 6 is a diagram illustrating an embodiment of calculating a saturation voltage of the light emitting element of each of the plurality of display devices shown in FIG. 1.

Referring to FIGS. 5 and 6, a graph illustrated in FIG. 6 shows change in luminance LUM according to change in second driving power voltage ELVSS to which the driving voltage Vel of the light emitting element EL is reflected. The second driving power voltage ELVSS is a voltage lower by a threshold voltage VthEL of the light emitting element EL than the driving voltage Vel of the light emitting element EL.

Referring to FIG. 6, the luminance LUM of an image displayed on the display panel PNL may decrease as the driving voltage Vel of the light emitting element EL increases. That is, referring to FIGS. 5 and 6, the driving voltage Vel of the light emitting element EL and the luminance LUM of an image displayed on the display panel PNL may be changed as the second driving power voltage ELVSS is changed.

Referring to FIGS. 3 to 6, the luminance measurer 20 may be connected to the first electrode (or the fourth node N4) of the light emitting element EL of the display panel PNL included in each of the plurality of display devices 10(1) to 10(N), to measure a luminance LUM.

Referring to FIG. 6, the luminance measurer 20 may transmit, to the driving voltage measurer 30, data including a luminance LUM corresponding to the second driving power voltage ELVSS changed as shown in FIG. 5.

The driving voltage measurer 30 may measure a variation of the luminance LUM. The driving voltage measurer 30 may calculate a voltage corresponding to a point at which the variation of the luminance LUM is changed as a saturation voltage Vsat for driving the display panel PNL.

In an embodiment, the luminance of an image displayed on the display panel PNL may be changed as the second driving power voltage ELVSS is changed. The voltage corresponding to the point at which the variation of the luminance LUM is changed may be determined as the saturation voltage Vsat. In an embodiment, for example, when the second driving power voltage ELVSS is changed, the luminance LUM of the image gradually falls with about a first slope ③ and then falls with a second slope ④ steeper than the first slope ③ at a specific time. The driving voltage measurer 30 may determine, as the saturation voltage Vsat, a voltage corresponding to the point at which the luminance LUM of the image falls with a second slope ④ steeper than the first slope ③.

In such an embodiment, the driving voltage measurer 30 may calculate a saturation voltage Vsat of the display panel PNL included in each of the plurality of display devices 10(1) to 10(N).

Figure 7:
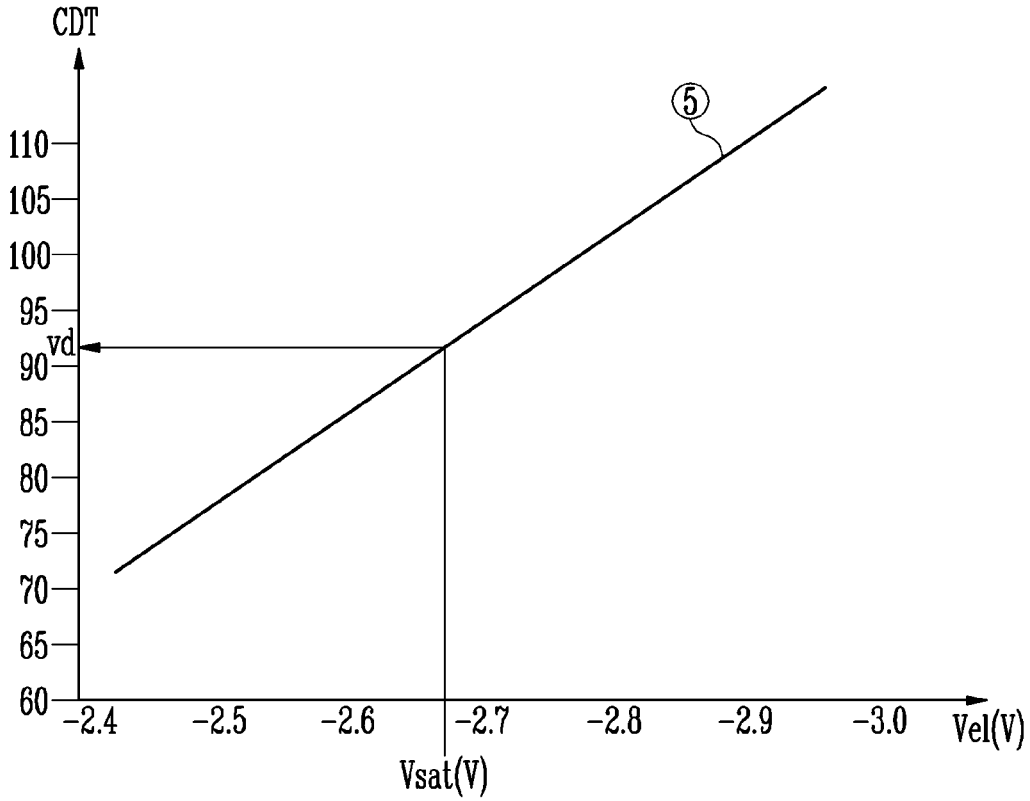
FIG. 7 is a diagram illustrating an embodiment of calculating a current density and a degradation weight value of each of the plurality of display devices shown in FIG. 1.

FIG. 7 is a diagram illustrating an embodiment of calculating a current density and a degradation weight value of each of the plurality of display devices shown in FIG. 1.

In an embodiment, the processor 40 may calculate a current density CDT of the display panel PNL provided in each of the plurality of display devices 10(1) to 10(N) by using the saturation voltage Vsat calculated by the driving voltage measurer 30.

Referring to FIG. 7, the current density CDT may increase as the driving voltage Vel of the light emitting element EL increases. The current density CDT according to the driving voltage Vel of the light emitting element EL may be experimentally measured to be pre-stored in the memory 400. In an embodiment, the current density CDT may satisfy the following Equation 1.

$$CDT(\text{current density}) = a \times Vsat(\text{saturation voltage}) + d \quad \text{(here, } a \text{ and } d \text{ are constants)} \qquad \text{[Equation 1]}$$

In an embodiment, the memory 400 included in the processor 40 may pre-store a plurality of parameters (e.g., a and d in Equation 1) for calculating the current density CDT. The calculator 401 included in the processor 40 may calculate a current density CDT (e.g., a first current density Vd in FIG. 7) of the display panel PNL provided in each of the plurality of display devices 10(1) to 10(N) by using the saturation voltage Vsat calculated by the driving voltage measurer 30 and the plurality of parameters (a and d) stored in the memory 400.

In an embodiment, although not shown in FIG. 7, the processor 40 may calculate a degradation weight value B of the display panel PNL provided in each of the plurality of display devices 10(1) to 10(N) by using the calculated current density CDT (or first current density Vd).

In an embodiment, the degradation weight value B may satisfy the following Equation 2.

$$B(\text{degradation weight value}) = \exp\left(S * \left(Th * \left(\left(\frac{i}{istd}\right) * \left(\frac{V}{Vstd}\right)\right)^{Acc}\right)^{1/T}\right) \qquad \text{[Equation 2]}$$

In Equation 2, S denotes a slope constant, T denotes a time constant, Th denotes a driving time, and Acc denotes an acceleration coefficient. In Equation 2, istd denotes a center value of a luminance LUM of the display panel PNL provided in each of the plurality of display devices 10(1) to 10(N), i denotes a luminance LUM of a display panel PNL provided in a measurement target display device, Vstd denotes a center value of a current density CDT of the display panels PNL provided in each of the plurality of display devices 10(1) to 10(N), and V denotes a current density CDT of the display panel PNL provided in a measurement target display device.

In an embodiment, the memory 400 included in the processor 40 may pre-store a plurality of parameters S, T, and ACC for calculating the degradation weight value B.

The calculator 401 included in the processor 40 may calculate a center value istd of a luminance LUM of the display panel PNL provided in each of the plurality of display devices 10(1) to 10(N). The center value istd of the luminance LUM corresponds to a median value of different luminances LUM measured in the display panels PNL provided in the plurality of display devices 10(1) to 10(N).

The calculator 401 included in the processor 40 may calculate a center value Vstd of a current density CDT of the display panel PNL provided in each of the plurality of display devices 10(1) to 10(N). The center value Vstd of the current density CDT corresponds to a median value of different current densities CDT calculated in the display panel PNL provided in each of the plurality of display devices 10(1) to 10(N).

The calculator 401 included in the processor 40 may calculate the degradation weight value B of the display panel PNL provided in the measurement target display device by using the center value istd of the luminance LUM, the center value of the current density CDT, the luminance i of the measurement target display device, the current density CDT of the measurement target display device, and the plurality of parameters S, T, ACC stored in the memory 400 at the driving time Th.

In an embodiment, as described above, data (or a degradation weight value B) for correcting an afterimage between the plurality of produced display devices 10(1) to 10(N) may be calculated by measuring the driving voltage Vel (see FIG. 5) of the plurality of display devices 10(1) to 10(N) in the manufacturing process of the plurality of display devices 10(1) to 10(N). The processor 40 may supply the data control signal Dcon including the calculated degradation weight value B of each of the plurality of display devices 10(1) to 10(N) to a produced measurement target display device, and perform degradation compensation on the plurality of display devices 10(1) to 10(N), thereby compensating for the afterimage. Accordingly, the plurality of display devices 10(1) to 10(N) may be manufactured to have uniform quality.

Figure 8:
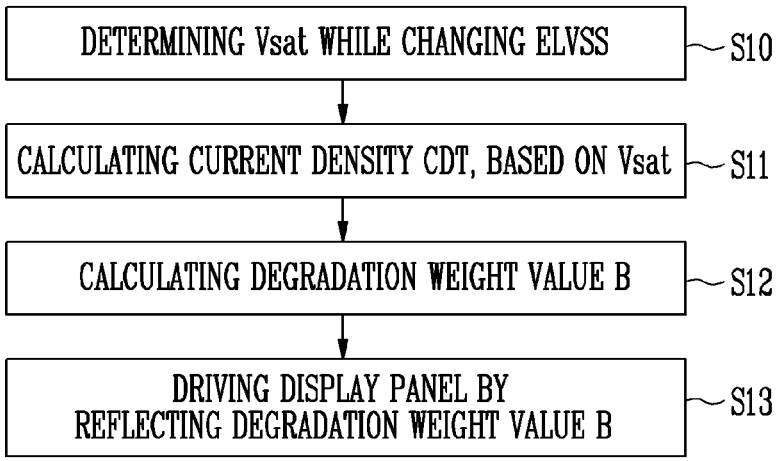
FIG. 8 is a flowchart illustrating a driving method of the display manufacturing system in accordance with an embodiment of the disclosure.

FIG. 8 is a flowchart illustrating a driving method of the display manufacturing system in accordance with an embodiment of the disclosure.

In an embodiment, a luminance LUM of a display panel PNL may be measured corresponding to the second driving power voltage ELVSS which is changed, and a saturation voltage Vsat may be calculated (S10).

In such an embodiment, the luminance measurer 20 may measure a luminance LUM of an image output from the pixel PX22 located at a central portion of the display panel PNL, corresponding to the second driving power voltage ELVSS which is changed. The driving voltage measurer 30 may calculate a saturation voltage Vsat by measuring a variation of the luminance LUM. Only the pixel PX22 located at the central portion of the display panel PNL is driven, and the other pixels PX11, PX21, PX31, PX12, PX32, PX13, PX23, and PX33 are not driven. Also, the pixel PX22 located at the central portion of the display panel PNL emits light of only one color.

In an embodiment, the processor 40 may calculate a current density CDT of each of the plurality of display devices 10(1) to 10(N), based on the calculated saturation voltage Vsat (S11).

In such an embodiment, the calculator 401 included in the processor 40 may calculate a current density CDT of the display panel PNL provided in each of the plurality of display devices 10(1) to 10(N) by using the saturation voltage Vsat of the display panel PNL provided in each of the plurality of display devices 10(1) to 10(N) and a plurality of parameter a and d stored in the memory 400.

In an embodiment, the processor 40 may calculate a degradation weight value B of each of the plurality of display devices 10(1) to 10(N) by using the calculated current density CDT (S12).

In such an embodiment, the processor 40 may calculate a degradation weight value B of the display panel PNL provided in each of the plurality of display devices 10(1) to 10(N) by using the current density of the display panel PNL provided in each of the plurality of display devices 10(1) to 10(N) and a plurality of parameters S, T, and ACC stored in the memory 400.

In an embodiment, the processor 40 may drive a measurement target display panel by reflecting the degradation weight value B (S13).

In such an embodiment, the processor 40 may calculate data (or a degradation weight value B) for correcting an afterimage between the plurality of produced display devices 10(1) to 10(N) by measuring the driving voltage Vel (see FIG. 5) of the plurality of display devices 10(1) to 10(N) in the manufacturing process of the plurality of display devices 10(1) to 10(N). The processor 40 may supply, to a measurement target display device, a data control signal Dcon including the calculated degradation weight value B of each of the plurality of display devices 10(1) to 10(N), and perform degradation compensation on the plurality of display devices 10(1) to 10(N), thereby compensating for the afterimage.

Figure 9:
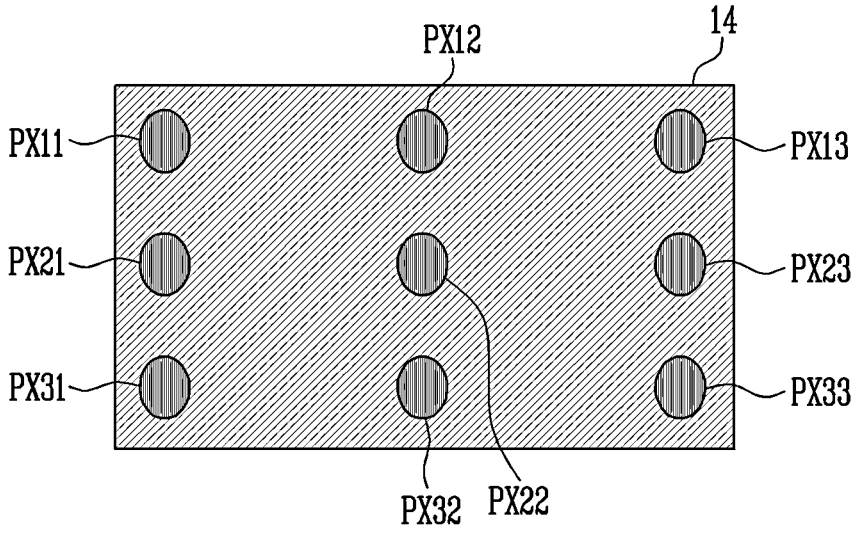
FIG. 9 is a diagram illustrating an alternative embodiment of calculating a degradation weight value of each of the plurality of display devices shown in FIG. 1.

FIG. 9 is a diagram illustrating an alternative embodiment of calculating a degradation weight value of each of the plurality of display devices shown in FIG. 1.

Referring to FIG. 9, the pixel unit 14 may include a plurality of pixels PX11, PX21, PX31, PX12, PX22, PX32, PX13, PX23, and PX33. Although an embodiment where the pixel unit 14 includes 9 pixels is illustrated in FIG. 4, the disclosure is not limited thereto.

In a manufacturing process of a plurality of display devices 10(1) to 10(N), when the area of a display panel PNL of each of the plurality of produced display devices 10(1) to 10(N) is a large area, degradation weight values B may be different from each other even between pixels PX11, PX21, PX31, PX12, PX22, PX32, PX13, PX23, and PX33 included in one pixel unit 14.

In such an embodiment, a degradation weight value B of a display panel PNL provided in each of the plurality of display devices 10(1) to 10(N) may be calculated by driving all the plurality of pixels PX11, PX21, PX31, PX12, PX22, PX32, PX13, PX23, and PX33 included in each of the plurality of display devices 10(1) to 10(N).

In such an embodiment, it is assumed that the plurality of pixels PX11, PX21, PX31, PX12, PX22, PX32, PX13, PX23, and PX33 are all driven to calculate each of the degradation weight values B between the pixels PX11, PX21, PX31, PX12, PX22, PX32, PX13, PX23, and PX33 included in one pixel unit 14.

In such an embodiment, it is assumed that the plurality of pixels PX11, PX21, PX31, PX12, PX22, PX32, PX13, PX23, and PX33 included in the pixel unit 14 emit light of one color. In such an embodiment, it is assumed that the plurality of pixels PX11, PX21, PX31, PX12, PX22, PX32, PX13, PX23, and PX33 included in the plurality of display devices 10(1) to 10(N) emit light of only one color among a first color (red), a second color (blue), and a third color (green), for example. In such an embodiment, the plurality of pixels PX11, PX21, PX31, PX12, PX22, PX32, PX13, PX23, and PX33 included in the plurality of display devices 10(1) to 10(N) are substantially the same as those described above with reference to FIG. 4, and any repetitive detailed description thereof will be omitted.

Referring to FIGS. 3 and 9, the luminance measurer 20 may be connected to the first electrode (or the fourth node N4) of the light emitting element EL provided in the pixel PX22 located at a central portion of the display panel PNL of each of the plurality of display devices 10(1) to 10(N) produced in a display manufacturing process, to measure a driving current IEL flowing through the light emitting element EL as the second driving power voltage ELVSS is changed.

The driving voltage measurer 30 may measure a variation of a luminance LUM of the pixel PX22 located at the central portion of the display panel PNL, and calculate a voltage corresponding to a point at which the variation of the luminance LUM is changed as a saturation voltage Vsat for driving the display panel PNL. Such an operation of the driving voltage measure 30 is substantially the same as that described above with reference to FIG. 6, and any repetitive detailed description thereof will be omitted.

The processor 40 may calculate a current density CDT of each of the plurality of produced display devices 10(1) to 10(N) by using the saturation voltage Vsat calculated by the driving voltage measurer 30.

in such an embodiment, the processor 40 may calculate a current density CDT of the display panel PNL provided in each of the plurality of display devices 10(1) to 10(N) by using the pixel PX22 located at the central portion of the display panel PNL provided in each of the plurality of display devices 10(1) to 10(N).

In such an embodiment, the processor 40 may calculate a degradation weight value B of the display panel PNL provided in each of the plurality of display devices 10(1) to 10(N) by using the calculated current density CDT.

In an embodiment, the degradation weight B may satisfy the following Equation 3.

[Equation 3]

$$B(\text{degradation weight value}) = \exp\left(S * \left(Th * \left(\left(\left(\frac{i}{istd}\right) * \left(\frac{V}{Vstd}\right) * L\right)^{Acc}\right)\right)^{1/T}\right)$$

In Equation 3, S denotes a slope constant, T denotes a time constant, Th denotes a driving time, and Acc denotes an acceleration coefficient. In Equation 3, istd denotes a center value of a luminance LUM of each of the plurality of display devices 10(1) to 10(N), i denotes a luminance LUM of a display panel PNL provided in a measurement target display device, Vstd denotes a center value of a current density CDT of each of the plurality of display devices 10(1) to 10(N), V denotes a current density CDT of the display panel PNL provided in a measurement target display device, and L denotes a compensation parameter for each pixel position.

The calculator 401 included in the processor 40 may calculate a compensation parameter L for each pixel position of the plurality of pixels PX11, PX21, PX31, PX12, PX22, PX32, PX13, PX23, and PX33 included in the pixel unit 14.

In such an embodiment, the compensation parameter L for each position of the pixel PX11 may be calculated as a value of a current density CDT of the pixel PX11 over a current density CDT of the pixel PX22, that is, a ratio of the current density CDT of the pixel PX11 with respect to the current density CDT of the pixel PX22. The compensation parameter L for each position of the pixel PX21 may be calculated as a value of a current density CDT of the pixel PX21 over the current density CDT of the pixel PX22. The compensation parameter L for each position of the pixel PX31 may be calculated as a value of a current density CDT of the pixel PX31 over the current density CDT of the pixel PX22. The compensation parameter L for each position of the pixel PX12 may be calculated as a value of a current density CDT of the pixel PX12 over the current density CDT of the pixel PX22. The compensation parameter L for each position of the pixel PX32 may be calculated as a value of a current density CDT of the pixel PX32 over the current density CDT of the pixel PX22. The compensation parameter L for each position of the pixel PX13 may be calculated as a value of a current density CDT of the pixel PX13 over the current density CDT of the pixel PX22. The compensation parameter L for each position of the pixel PX23 may be calculated as a value of a current density CDT of the pixel PX23 over the current density CDT of the pixel PX22. The compensation parameter L for each position of the pixel PX33 may be calculated as a value of a current density CDT of the pixel PX33 over the current density CDT of the pixel PX22.

In such an embodiment, as described above, degradation compensation for each position of pixels PX11, PX21, PX31, PX12, PX22, PX32, PX13, PX23, and PX33 in one display device may be performed by considering the compensation parameter L for each position of the plurality of pixels PX11, PX21, PX31, PX12, PX22, PX32, PX13, PX23, and PX33 in the pixel unit 14 when the degradation weight value B is calculated. Accordingly, when the display device has a large area, the plurality of display devices 10(1) to 10(N) may be manufactured to have uniform lifetime by performing degradation compensation.

Figure 10:
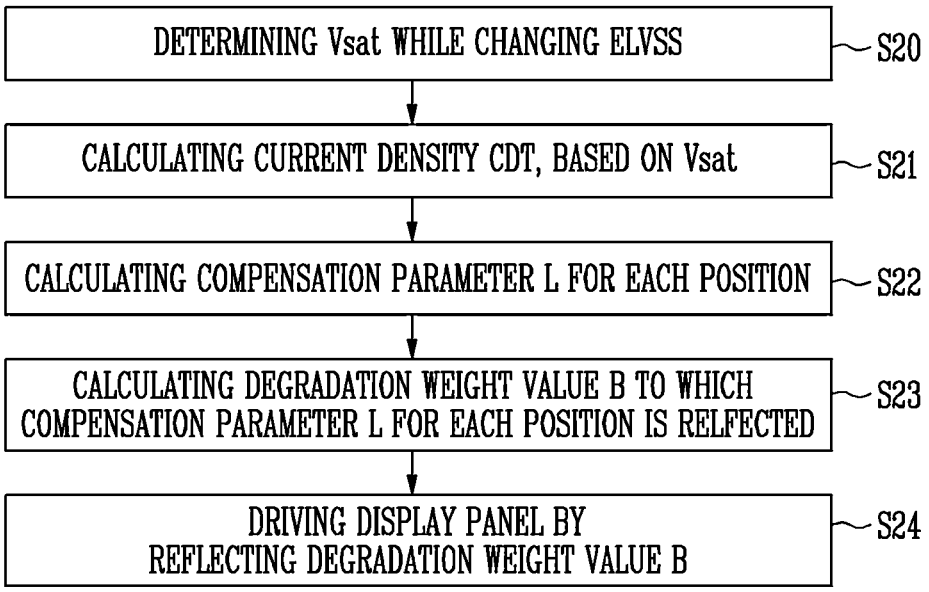
FIG. 10 is a flowchart illustrating a driving method of the display manufacturing system in accordance with an alternative embodiment of the disclosure.

FIG. 10 is a flowchart illustrating a driving method of the display manufacturing system in accordance with an alternative embodiment of the disclosure.

In an embodiment, a luminance LUM of a display panel PNL may be measured, and a saturation voltage Vsat may be calculated (S20).

In such an embodiment, the luminance measurer 20 may measure a luminance LUM of an image output from the pixel PX22 located at a central portion of the display panel PNL, corresponding to the second driving power voltage ELVSS. The driving voltage measurer 30 may calculate a saturation voltage Vsat by measuring a venation of the luminance LUM. A plurality of pixels PX11, PX21, PX31, PX12, PX22, PX32, PX13, PX23, and PX33 included in the display panel PNL are all driven. Also, the plurality of pixels PX11, PX21, PX31, PX12, PX22, PX32, PX13, PX23, and PX33 included in the display panel PNL emit light only one color.

In an embodiment, the processor 40 may calculate a current density CDT of each of the plurality of display devices 10(1) to 10(N), based on the calculated saturation voltage Vsat (S21).

In such an embodiment, the calculator 401 included in the processor 40 may calculate a current density CDT of the display panel PNL provided in each of the plurality of display devices 10(1) to 10(N) by using the saturation voltage Vsat of the display panel PNL provided in each of the plurality of display devices 10(1) to 10(N) and a plurality of parameter a and d stored in the memory 400.

In an embodiment, the processor 40 may calculate a compensation parameter L for each position of pixels PXij included in the display panel PNL (S22).

In such an embodiment, the calculator 401 included in the processor 40 may calculate a compensation parameter L for each position of each of the plurality of pixels PX11, PX21, PX31, PX12, PX22, PX32, PX13, PX23, and PX33 included in the display panel PNL, based on the current density CDT of the pixel PX22 located at a central portion of the display panel PNL.

In an embodiment, the processor 40 may calculate a degradation weight value B of the display panel PNL of each of the plurality of display devices 10(1) to 10(N) by using the compensation parameter L for each position and the current density CDT (S23).

In such an embodiment, the processor 40 may calculate a degradation weight value B of the display panel PNL of each of the plurality of display devices 10(1) to 10(N) by using the current density CDT of the display panel PNL of each of the plurality of display devices 10(1) to 10(N), the compensation parameter L for each position, and a plurality of parameter S, T, and ACC stored in the memory 400.

In an embodiment, the processor 40 may drive a measurement target display panel by reflecting the degradation weight value B (S24).

In such an embodiment, the processor 40 may drive the display panel PNL by supplying a data control signal Dcon including the degradation weight value B to the measurement target display device.

In embodiments of the display manufacturing system and the driving method of the display manufacturing system in accordance with the disclosure, a lifetime characteristic of display devices can be predicted through measurement of a driving power voltage in a process of manufacturing the display devices.

In embodiments of the display manufacturing system and the driving method of the display manufacturing system in accordance with the disclosure, the lifetime of display devices can be controlled to be constant by using a lifetime distribution of the display devices.

In embodiments of the display manufacturing system and the driving method of the display manufacturing system in accordance with the disclosure, a lifetime distribution is predicted and compensated in a process of manufacturing display devices, thereby reducing manufacturing time and improving productivity.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display manufacturing system comprising:

a plurality of display devices, each including a display panel which displays an image;

a driving voltage measurer which calculates a saturation voltage corresponding to a luminance of the image displayed on the display panel by changing a driving power voltage for driving the display panel; and a processor which calculates a current density and a degradation weight value based on the saturation voltage, and controls the display panel included in each of the plurality of display devices based on the current density and the degradation weight value, wherein the processor calculates the degradation weight value, based on a center value of the current density of the display panel included in each of the plurality of display devices and the current density of a target display panel.

2. The display manufacturing system of claim 1, wherein the saturation voltage is a voltage corresponding to a point at which a variation of the luminance is changed as the driving power voltage connected to a light emitting element of the display panel is changed.

3. The display manufacturing system of claim 1, wherein the processor includes:

a memory which pre-stores a plurality of parameters for calculating the current density and the degradation weight value; and a calculator which calculates the current density and the degradation weight value, based on the plurality parameters.

4. The display manufacturing system of claim 3, wherein the calculator calculates the degradation weight value, based on a center value of the luminance of the display panel included in each of the plurality of display devices and the luminance of the target display panel.

5. The display manufacturing system of claim 3, wherein the memory pre-stores the current density corresponding to a change in driving voltage of a light emitting element of the display panel, and wherein the driving voltage of the light emitting element is a voltage higher by a threshold voltage of the light emitting element than the driving power voltage.

6. The display manufacturing system of claim 5, wherein the driving voltage of the light emitting element is a voltage corresponding to at a point at which a current flowing through the light emitting element and a current flowing through a driving transistor of the display panel are the same as each other.

7. The display manufacturing system of claim 5, wherein the calculator calculates the current density corresponding to the saturation voltage by using the current density pre-stored in the memory.

8. The display manufacturing system of claim 1, wherein the image is displayed by using at least one of a first color, a second color, and a third color, and wherein the current density is calculated when the image is displayed by using one of the first color, the second color, and the third color.

9. A display manufacturing system comprising:

a plurality of display devices, each including a display panel which displays an image;

a driving voltage measurer which calculates a saturation voltage corresponding to a luminance of the image displayed on the display panel by changing a driving power voltage for driving the display panel; and a processor which calculates a current density and a degradation weight value based on the saturation voltage, and controls the display panel included in each of the plurality of display devices based on the current density and the degradation weight value, wherein the display panel includes a plurality of pixels, and wherein the processor calculates the current density and the degradation weight value, based on a center value of the current density of the plurality of pixels and a center value of the current density calculated in a target pixel.

10. A method of driving a display manufacturing system including a plurality of display devices, a driving voltage measurer, and a processor, the method comprising:

displaying, by a display panel, an image, wherein the display panel is included in each of the plurality of display devices;

calculating, by the driving voltage measurer, a saturation voltage corresponding to a luminance of the image displayed on the display panel by changing a driving power voltage for driving the display panel; and calculating, by the processor, a current density and a degradation weight value based on the saturation voltage, and controlling the display panel included in each of the plurality of display devices based on the current density and the degradation weight value, wherein the degradation weight value is calculated, based on a center value of the current density of the display panel included in each of the plurality devices and the current density of a target display panel.

11. The method of claim 10, wherein the calculating the saturation voltage corresponding to the luminance includes determining, by the driving voltage measurer, as the saturation voltage, a voltage corresponding to a point at which a variation of the luminance is changed as the driving power voltage connected to a light emitting element of the display panel is changed.

12. The method of claim 10, wherein the processor includes a memory and a calculator, and wherein the calculating, by the processor, the current density and the degradation weight value, based on the saturation voltage includes:

pre-storing, by the memory, a plurality of parameters for calculating the current density and the degradation weight value; and calculating, by the calculator, the current density and the degradation weight value, based on the plurality of parameters.

13. The display manufacturing system of claim 1, wherein the display panel includes a pixel, and wherein the driving voltage measurer calculates a voltage corresponding to a point at which a variation of a luminance of the pixel is changed as the saturation voltage.

* * * * *